US011264188B2

(12) United States Patent
DeCarr et al.

(10) Patent No.: US 11,264,188 B2
(45) Date of Patent: Mar. 1, 2022

(54) OPERATOR FOR AN ELECTRICAL SWITCHING APPARATUS

(71) Applicant: Eaton Intelligent Power Limited, Dublin (IE)

(72) Inventors: Graig Edmund DeCarr, Cicero, NY (US); Adam D. Ledgerwood, Syracuse, NY (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 26 days.

(21) Appl. No.: 16/600,243

(22) Filed: Oct. 11, 2019

(65) Prior Publication Data

US 2020/0118775 A1 Apr. 16, 2020

Related U.S. Application Data

(60) Provisional application No. 62/744,487, filed on Oct. 11, 2018.

(51) Int. Cl.

| | |
|---|---|
| ***H01H 23/14*** | (2006.01) |
| ***H01H 9/22*** | (2006.01) |
| *H01H 71/56* | (2006.01) |
| *H01H 9/28* | (2006.01) |

(52) U.S. Cl.

CPC ..... *H01H 23/141* (2013.01); *H01H 9/22* (2013.01); *H01H 9/28* (2013.01); *H01H 71/56* (2013.01); *H01H 2071/565* (2013.01)

(58) Field of Classification Search

CPC ..... H01H 23/141; H01H 9/22; H01H 9/28; H01H 71/56

USPC ..... 200/331

See application file for complete search history.

(56) References Cited

U.S. PATENT DOCUMENTS

| | | | | |
|---|---|---|---|---|
| 5,634,553 A * | 6/1997 | Hopper | ..... | H01H 3/08 200/331 |
| 7,019,240 B2 * | 3/2006 | Eberts | ..... | H01H 3/46 200/331 |

* cited by examiner

*Primary Examiner* — Edwin A. Leon
*Assistant Examiner* — Iman Malakooti
(74) *Attorney, Agent, or Firm* — Stinson LLP

(57) ABSTRACT

An operator for an electrical switching apparatus includes an actuator configured to be grasped by a user. A linkage is attached to the actuator at a first end of the linkage and configured for extending through an enclosure housing the electrical switching apparatus. An engagement assembly is attached to the linkage at a second end of the linkage such that when the operator is mounted to the enclosure movement of the actuator outside of the enclosure causes movement of the engagement assembly inside the enclosure. The engagement assembly includes an extension arm attached to the linkage and an attachment member attached to the extension arm. The attachment member is configured to engage a toggle of the electrical switching apparatus in the enclosure to move the toggle between at least two positions.

14 Claims, 15 Drawing Sheets

OPERATOR FOR AN ELECTRICAL SWITCHING APPARATUS

CROSS-REFERENCE TO RELATED APPLICATION

This application claims priority to U.S. Provisional Patent Application Ser. No. 62/744,487, filed Oct. 11, 2018, which is hereby incorporated by reference in its entirety.

FIELD

The present disclosure generally relates to an operator for an electrical switching apparatus, and more particularly to an operator for an electrical switching apparatus wherein the operator has an attachment for engaging a toggle/switching component of the apparatus.

BACKGROUND

Electrical switching apparatus, such as molded case circuit breakers are often mounted behind a panel or housed within an enclosure (e.g., panel board, load center, switchgear cabinet, etc.) for operator safety and to prevent unauthorized access. FIG. 1 illustrates a through cover operator 1 of the prior art. The through cover operator 1 comprises a shaft 3 that extends between a handle 5 and a toggle engagement member or fork 7. When the through cover operator 1 is mounted on a cover 9 of an enclosure 11 (FIG. 2), the shaft 3 extends through the cover so that the handle 5 is located outside of the enclosure and the fork 7 is located inside the enclosure. The through cover operator 1 is mounted for rotation relative to the enclosure 11 so that actuation or rotation of the handle 5 causes the fork 7 to rotate. The fork 7 comprises two spaced apart fingers 13 configured to receive a toggle T of a circuit breaker CB within the enclosure 11 when the cover 9 is closed. Therefore, a user can engage the toggle T inside the enclosure 11 to flip the toggle on and off by actuating the handle 5 outside of the enclosure 11.

SUMMARY

In one aspect, an operator for an electrical switching apparatus generally comprises an actuator configured to be grasped by a user. A linkage is attached to the actuator at a first end of the linkage and configured for extending through an enclosure housing the electrical switching apparatus. An engagement assembly is attached to the linkage at a second end of the linkage such that when the operator is mounted to the enclosure movement of the actuator outside of the enclosure causes movement of the engagement assembly inside the enclosure. The engagement assembly comprises an extension arm attached to the linkage and an attachment member attached to the extension arm. The attachment member is configured to engage a toggle of the electrical switching apparatus in the enclosure to move the toggle between at least two positions.

In another aspect, an attachment member for an electrical switching apparatus operator generally comprises a body having an opening formed therein. The opening being sized and shaped to receive a toggle of the electrical switching apparatus such that edges of the body defining the opening are configured to engage the toggle for moving the toggle when the attachment member is attached to the operator and the operator is mounted to an enclosure housing the electrical switching apparatus.

BRIEF DESCRIPTION OF THE DRAWINGS

Corresponding reference characters indicate corresponding parts throughout the drawings.

DETAILED DESCRIPTION

Figure 1:
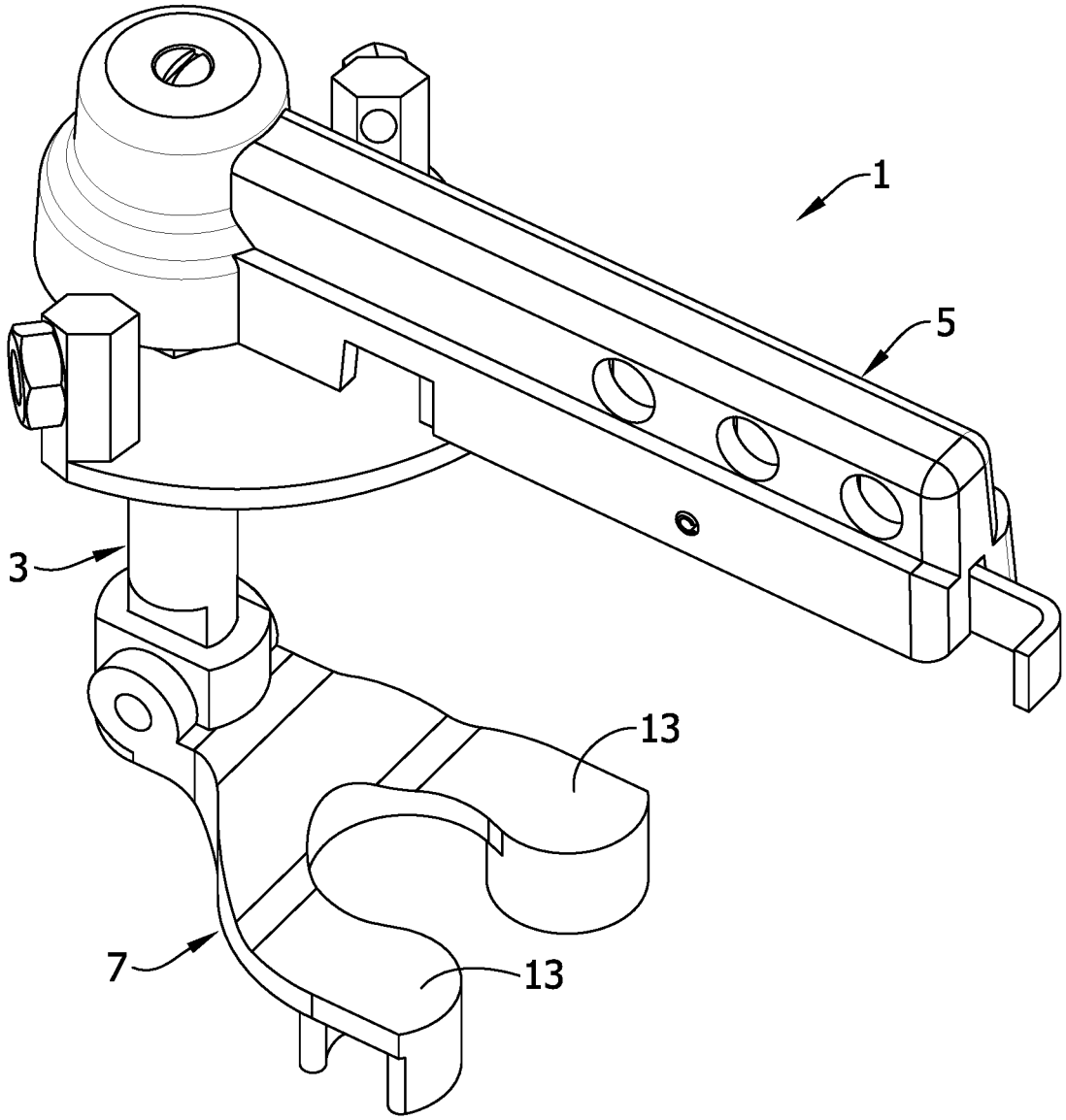
FIG. 1 PRIOR ART
FIG. 1 is a perspective of a prior art circuit breaker through cover operator.
Figure 2:
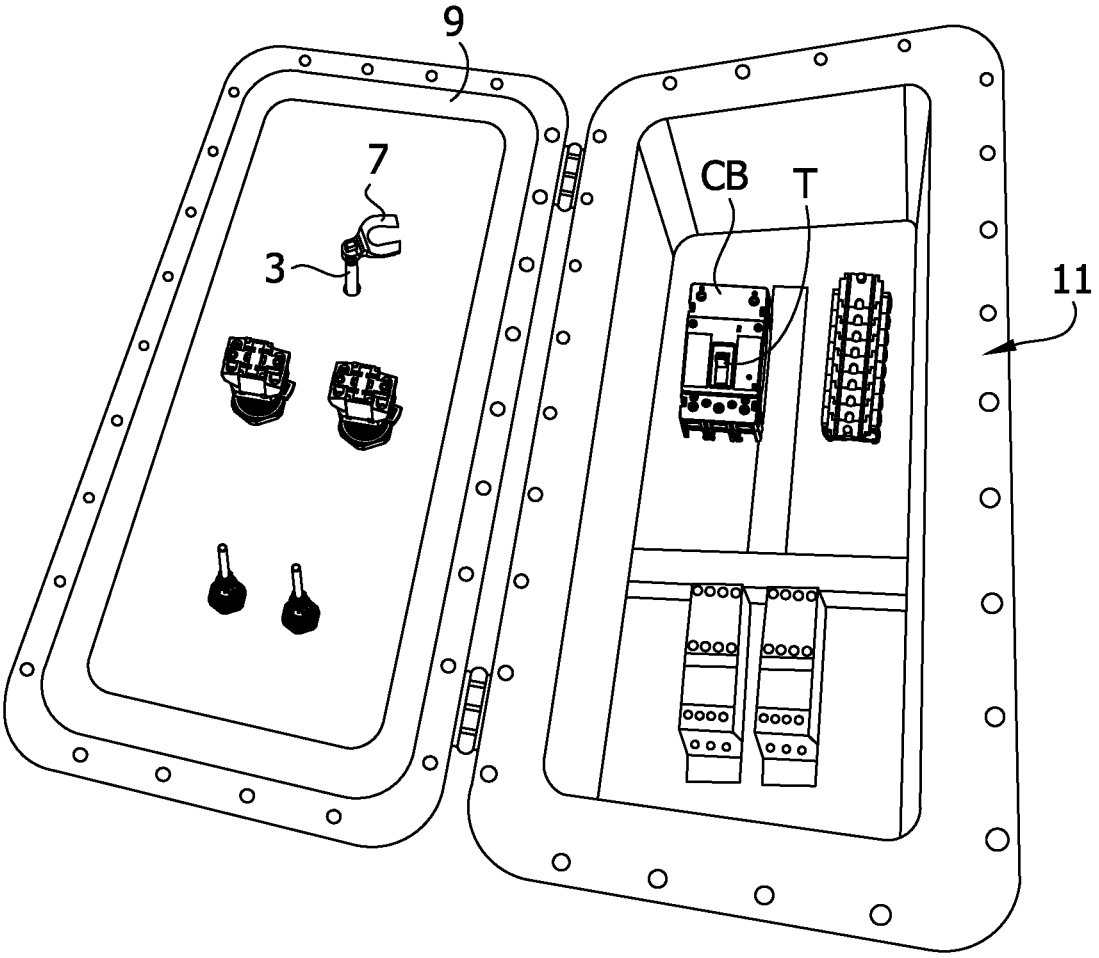
FIG. 2 PRIOR ART
FIG. 2 is a photo of a circuit breaker enclosure in an open configuration and having a prior art through cover operator mounted on a cover of the enclosure.
Figure 3:
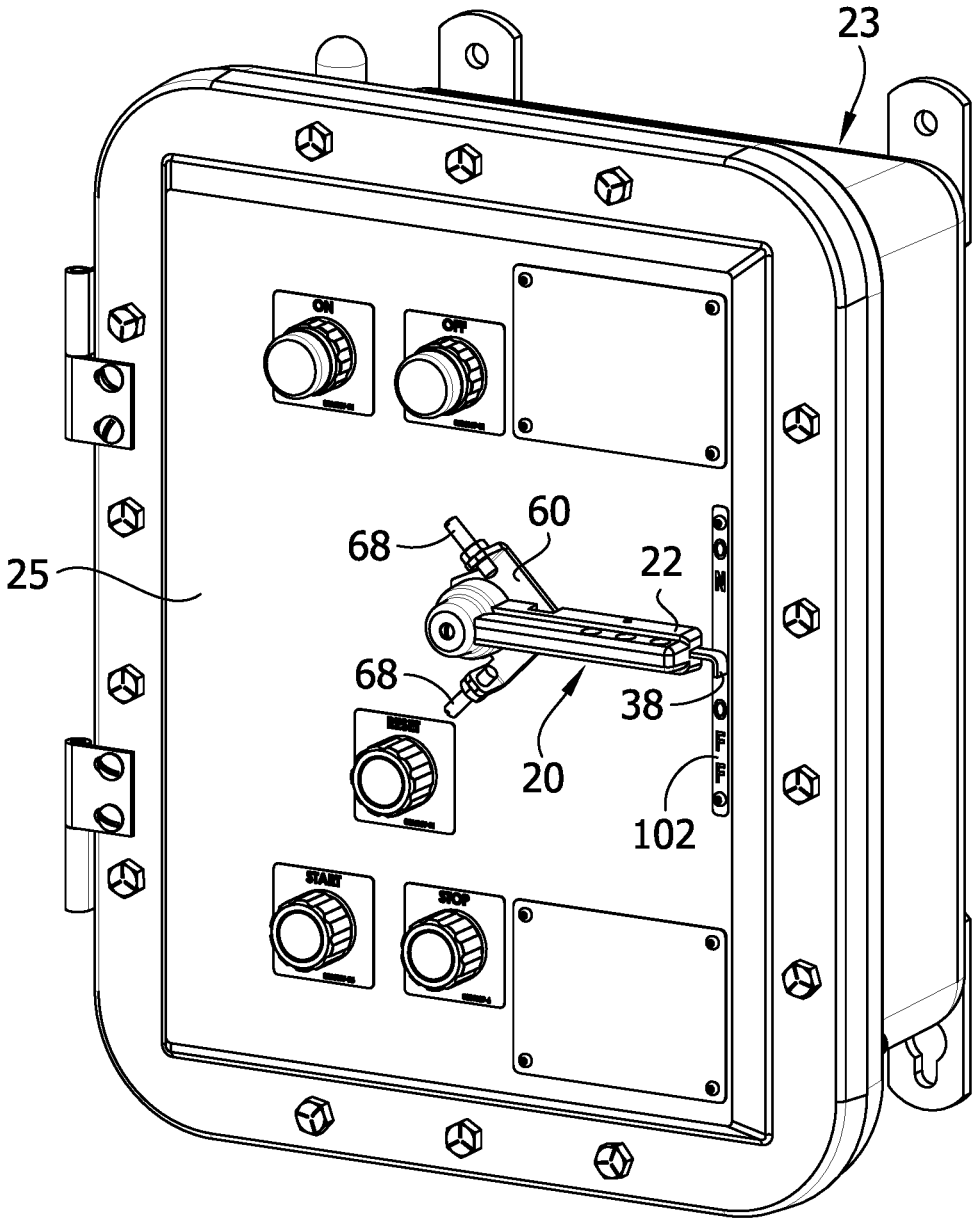
FIG. 3 is a perspective of a circuit breaker enclosure in a closed configuration and having a through cover operator of the present disclosure mounted on a cover of the enclosure.
Figure 4:
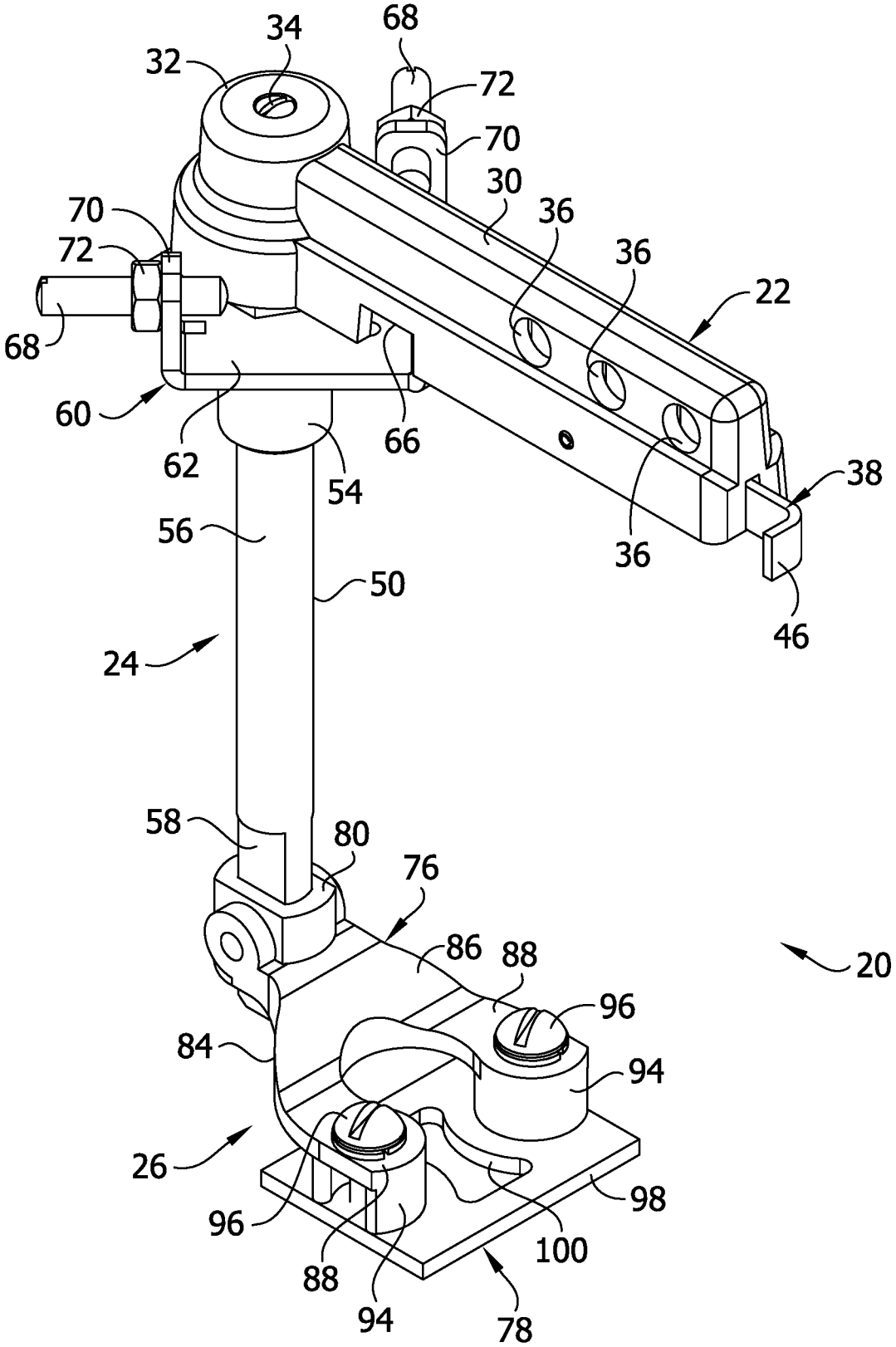
FIG. 4 is a perspective of the through cover operator of the present disclosure.
Figure 5:
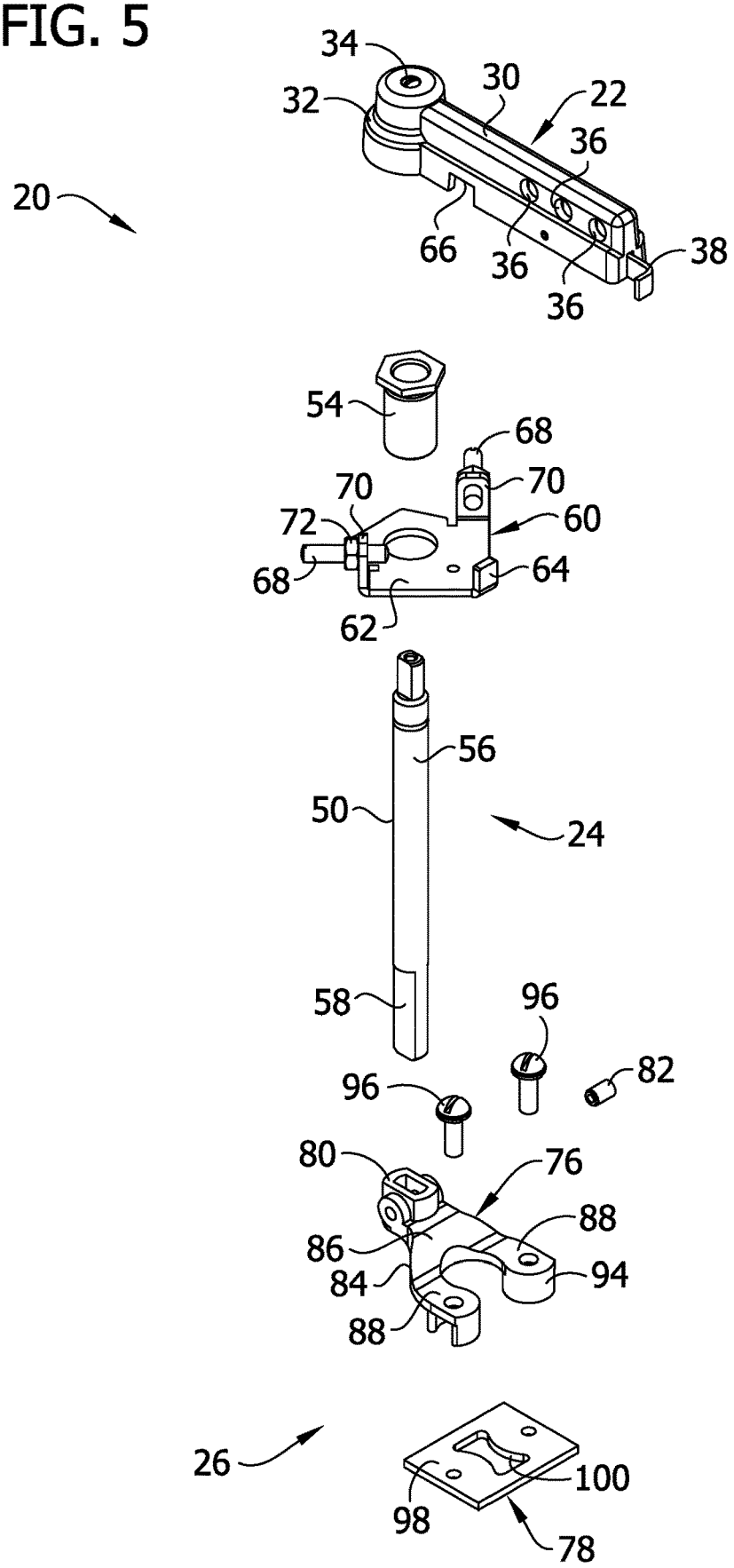
FIG. 5 is an exploded view of the through cover operator in FIG. 4.

Referring to FIGS. 3-5, one embodiment of a through cover circuit breaker operator is generally indicated at 20. The operator 20 comprises a handle 22 (broadly, an actuator) for disposal outside of a circuit breaker enclosure 23, a linkage assembly 24 (broadly, a linkage) attached to the handle at one end of the linkage assembly and configured to extend through a cover 25 of the enclosure, and a toggle engagement assembly 26 attached to an opposite end of the linkage assembly for operatively engaging a toggle T on a circuit breaker CB housed within the enclosure. The operator 20 is movably mounted to the enclosure so that actuation of the handle 22 outside of the enclosure causes the toggle engagement assembly 26 inside the enclosure to move. When the cover 25 of the enclosure 23 is closed, and the toggle engagement assembly 26 is positioned in registration with the toggle T on the circuit breaker CB, the movement of the handle 22 can cause the toggle engagement assembly 26 to engage the toggle to flip the toggle between at least two positions. In one embodiment, the at least two positions correspond to on and off positions of the circuit breaker CB. The toggle engagement assembly 26 is selectively configurable for use with the particular toggle engagement operation that is needed. Thus, the entire operator 20 does not have to be exchanged when different toggle engagement needs arise. Rather, only the toggle engagement assembly 26 needs to be reconfigured based on the toggle engagement requirements. Therefore, the present disclosure provides a toggle engagement assembly 26 that can be selectively reconfigured as needed. Additionally, the toggle engagement assembly 26 is configured to closely receive the toggle T such that a clearance between the toggle and the toggle engagement assembly is reduced as compared to the clearance between the ends of the toggle engagement member 7 of the prior art and the toggle T thus providing a closer tolerance between the toggle and the toggle engagement assembly. As a result, the movement of the handle 22 is better transferred into movement of the toggle T causing a more reliable actuation of the toggle by the through cover operator 20.

As employed herein, the statement that two or more parts are "attached" together shall mean that the parts are joined together either directly or joined through one or more intermediate parts.

As employed herein, the term "enclosure" refers to any suitable structure for housing an electrical switching apparatus (e.g., without limitation, circuit switching devices and circuit interrupters such as circuit breakers, contactors, motor starters, motor controllers and other load controllers) and expressly includes, without limitation, panel boards, load centers and switchgear cabinets, as well as other structures or compartments which are covered with a panel, such as, for example and without limitation, in a prepared opening in the wall of a building, in a piece of machinery, or in a vehicle.

As employed herein, the term "linkage" refers to any known or suitable mechanism for interconnecting one component to another component in order to provide mechanical communication therebetween and expressly includes, without limitation, a rigid member, such as a tube, a rod, a shaft, or a link, as well as combinations of a rigid member with a flexible member, such as a cable, a wire, a chain, and an interconnected link.

Figure 6:
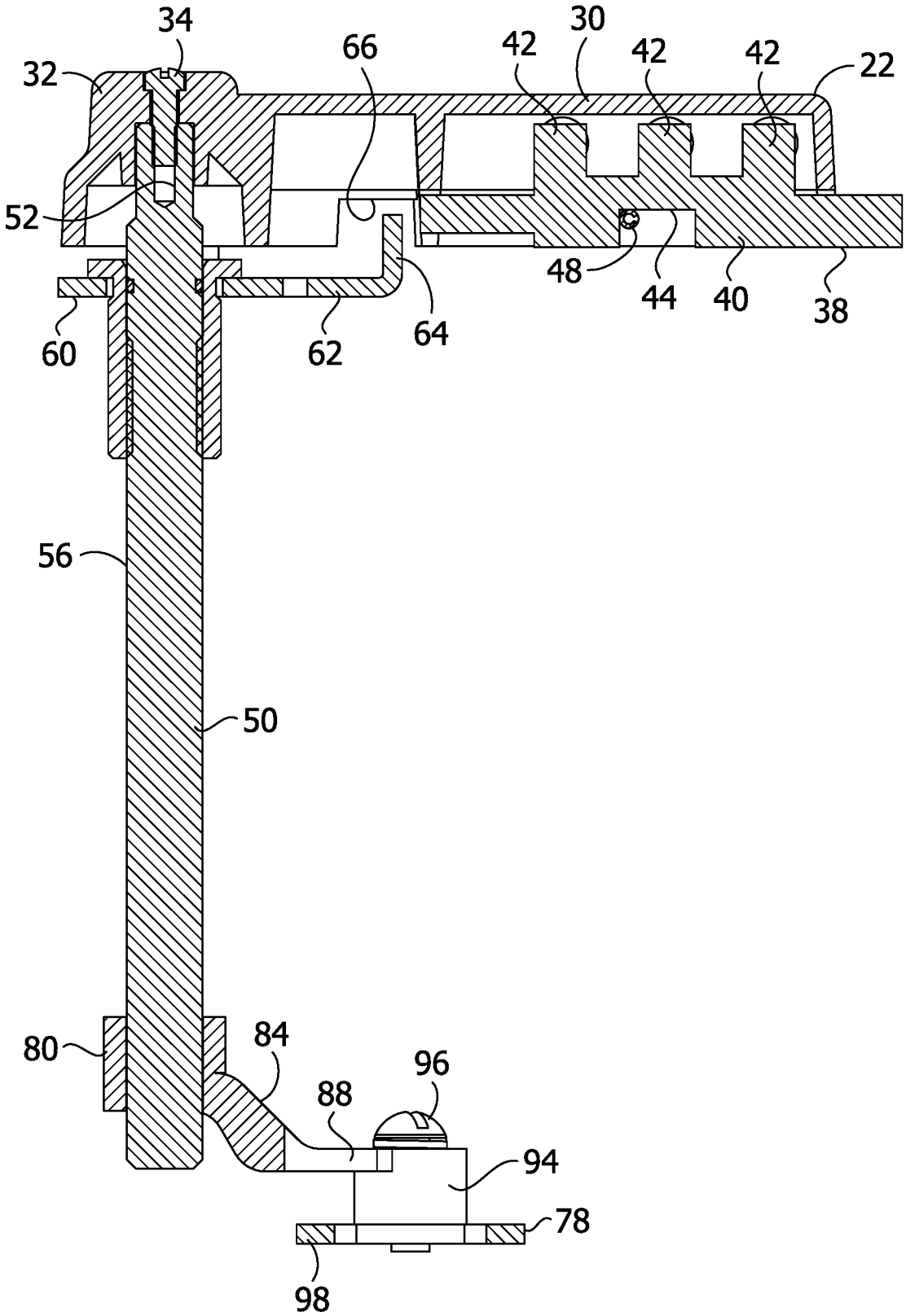
FIG. 6 is a section of the through cover operator in FIG. 4.
Figure 7:
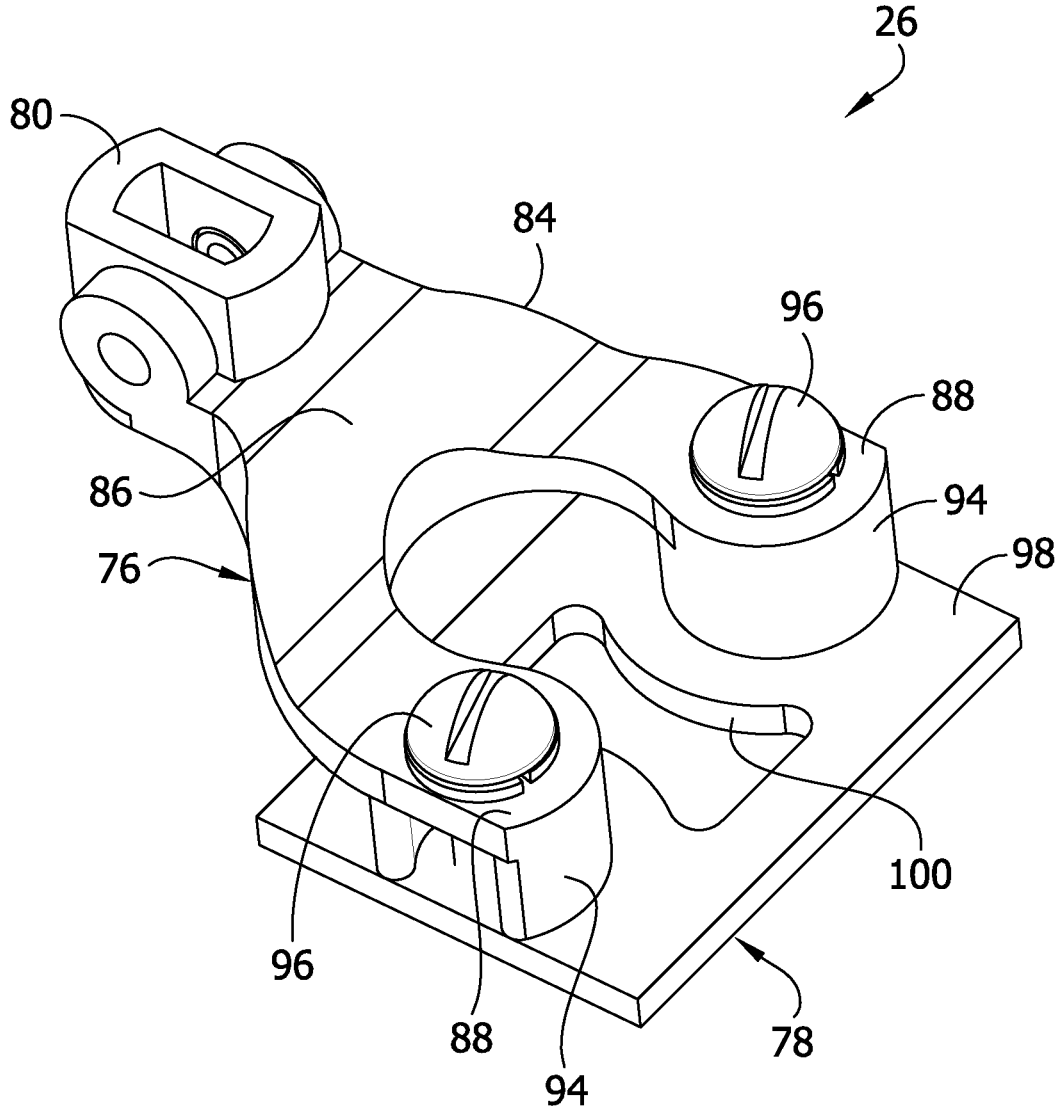
FIG. 7 is a perspective of a toggle engagement assembly of the operator.
Figure 8:
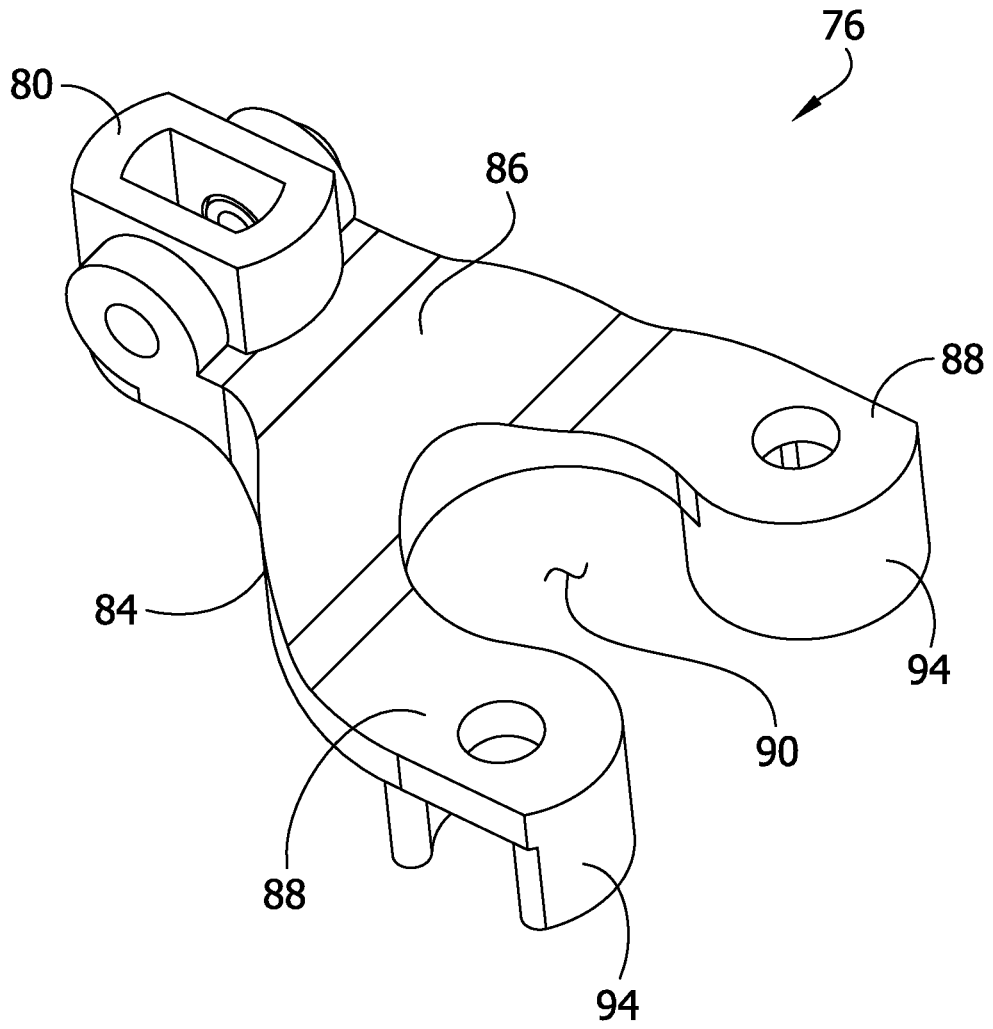
FIG. 8 is a perspective of a fork of the toggle engagement assembly.
Figure 9:
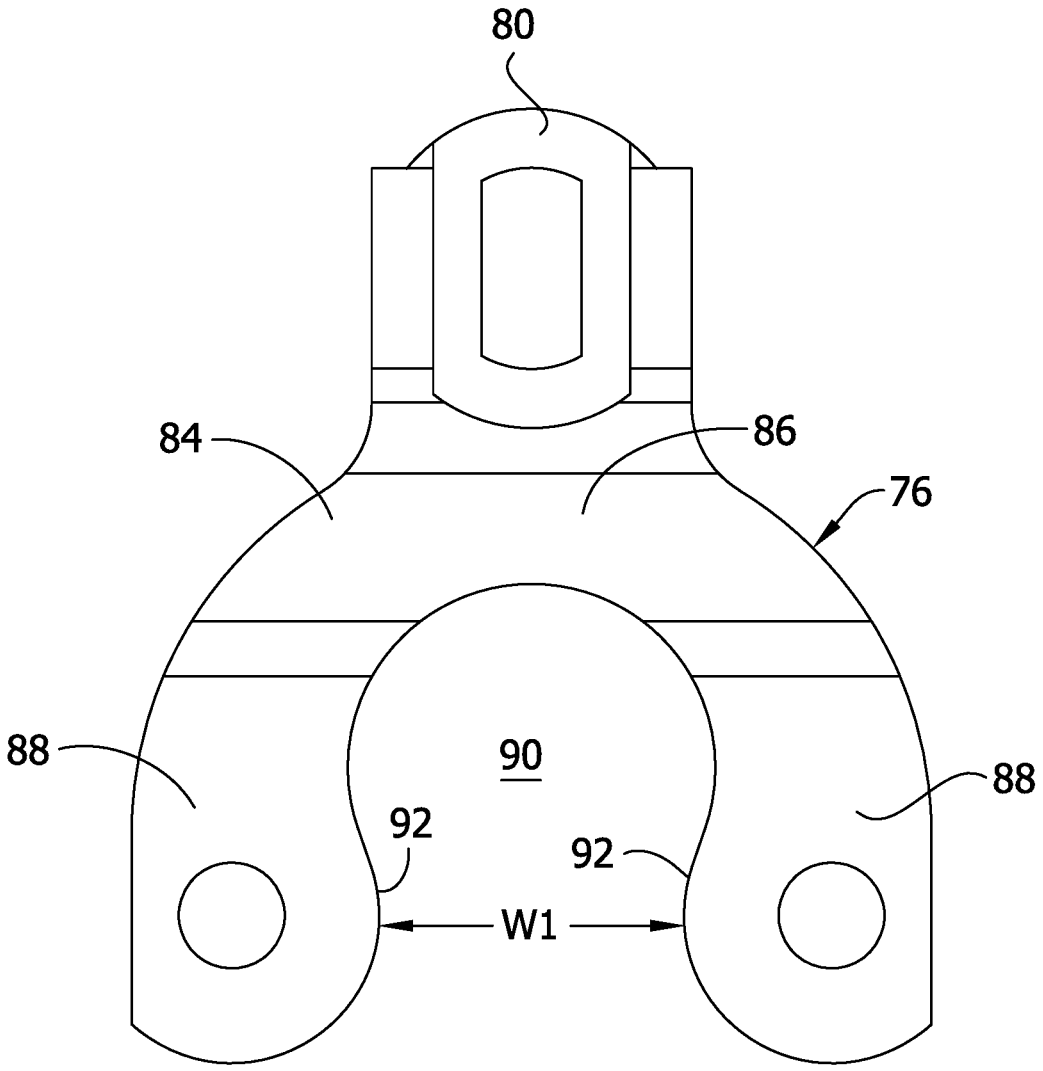
FIG. 9 is a top view of the fork.
Figure 10:
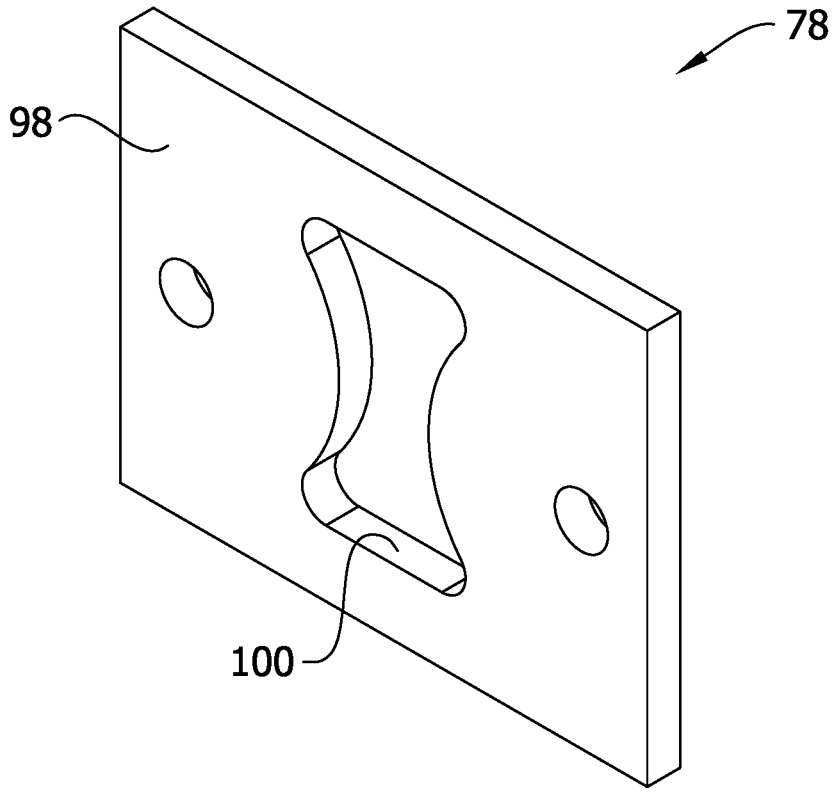
FIG. 10 is a perspective of an attachment plate of the toggle engagement assembly.
Figure 11:
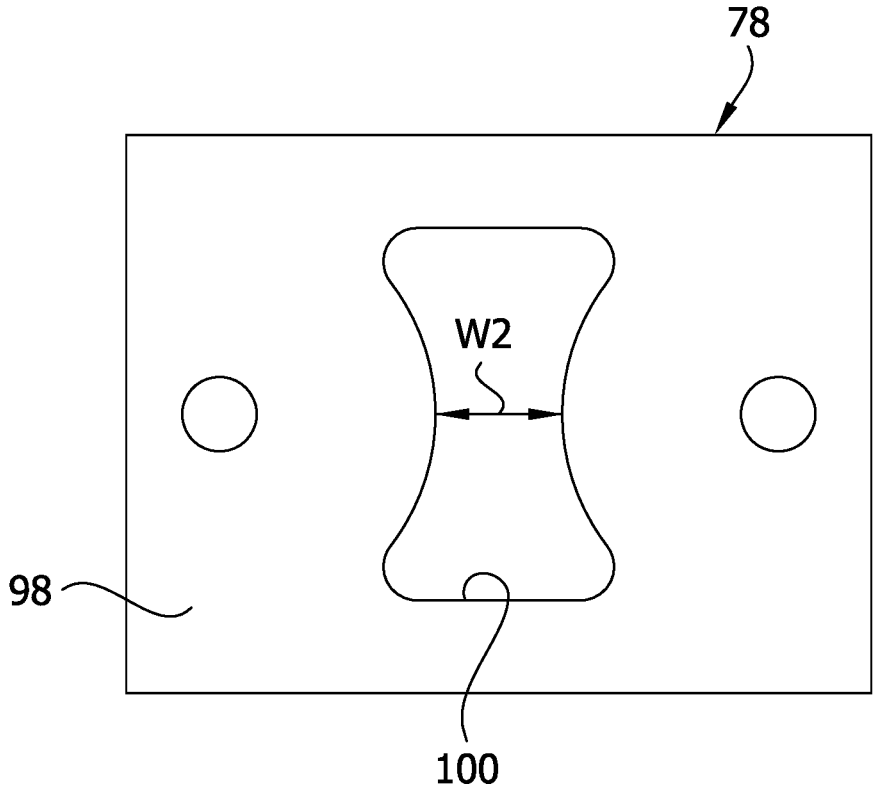
FIG. 11 is a front view of the attachment plate.

Referring to FIGS. 4-6, the handle 22 comprises an elongate portion 30 configured for gripping by a user to rotate the handle relative to the enclosure cover 25 when the operator 20 is mounted on the enclosure 23. The elongate portion 30 extends from a base 32 of the handle 22. The base 32 is attached to the linkage assembly 24 so that movement of the handle 22 is transferred to the linkage assembly. In the illustrated embodiment, a screw 34 attaches the base 32 of the handle 22 to the linkage assembly 24. However, other suitable attachment mechanisms are also envisioned. The elongate portion 30 includes a plurality of openings 36 in opposing longitudinal surfaces. The openings 36 on one longitudinal surface are in registration with an opening on the opposite longitudinal surface such that passages are established along the length of the elongate portion 30. It will be understood, however, that the handle 22 can have other configurations without departing from the scope of the disclosure. For example, the handle 22 can be any handle, knob, button, lever, or actuator for imparting movement of the linkage assembly 24.

A latch 38 is movably attached to the elongate portion 30 of the handle 22. The latch 38 comprises an elongate plate 40 that is partially received within the elongate portion 30 of the handle 22 and is slidable relative to the elongate portion. The plate 40 includes a plurality of tabs 42 projecting from one longitudinal edge of the plate, and a cutout 44 formed in an opposite longitudinal edge. The tabs 42 are longitudinally spaced along the plate 40. The plate 40 is bent at an exposed end to form a hook 46 which can be grabbed by the user to slide the latch 38 relative to the elongate portion 30. A pin 48 extends from an interior surface of the elongate portion 30 of the handle 22 and is received within the cutout 44. The pin 48 limits the amount the latch 38 can slide relative to the elongate portion 30. When the latch 38 is moved all the way out such that the pin 48 engages a first surface of the cutout 44 (FIG. 6), the tabs 42 are placed in registration with the openings 36 placing the operator 20 in an unlocked configuration. When the latch 38 is pushed all the way in such that the pin 48 engages a second surface of the cutout 44 opposite the first surface, the tabs 42 are moved out of registration with the openings 36. With openings 36 free of the tabs 42, a locking member (not shown) can be inserted through at least one of the pairs of openings 36 to place the operator 20 in a locked configuration. In one embodiment, the latch 38 is spring loaded such that the latch is biased away from the base 32 of the handle 22. In the illustrated embodiment, three sets of opening 36 and three tabs 42 are shown. However, other numbers of openings and tabs are also envisioned. Additionally, other methods of holding the latch 38 in the locked configuration are within the scope of the disclosure.

Referring to FIGS. 4-6, the linkage assembly 24 comprises an elongate linkage arm 50 directly attached to the base 32 of the handle 22 at a first longitudinal end of the linkage arm. In the illustrated embodiment, the screw 34 is threaded into a bore 52 in the first longitudinal end of the linkage arm 50 to attach the base 32 of the handle 22 to the linkage arm. A bearing 54 is received around the linkage arm 50 such that the linkage arm rotates in the bearing. The linkage arm 50 comprises a cylindrical portion 56 extending generally from the first longitudinal end toward an opposite second longitudinal end of the linkage arm. A generally rectangular portion 58 extends from the cylindrical portion 56 to the second longitudinal end. A section of the cylindrical portion 56 is received in the bearing 54 and facilitates the rotation of the linkage arm 50 in the bearing. The generally rectangular portion 58 includes planar side surfaces and rounded end surfaces. The shape of the generally rectangular portion 58 is configured to non-rotatably mount the toggle engagement assembly 26 to the linkage assembly 24 so that the movement (i.e., rotation) of the linkage assembly is transferred to the toggle engagement assembly. It is envisioned that the linkage assembly 24, including the linkage arm 50, can have other configurations without departing from the scope of the disclosure. Any configuration of the linkage assembly 24 that transfers the movement of the handle 22 to the toggle engagement assembly 26 is within the scope of the disclosure.

Referring to FIGS. 3-6, a locking plate 60 is attached to the linkage assembly 24 around the bearing 54. The locking plate 60 is configured to be engaged by the latch 38 when the latch is in the locked position to prevent the operator 20 from being rotated out of a selected position (e.g., on/off positions). In the illustrated embodiment, the locking plate 60 includes plate section 62 and a flange 64 bent outwardly from the plate section. The plate section 62 is configured to engage the cover 25 of the enclosure 23. The flange 64 is positioned to pass through a recess 66 in an inner side of the elongate portion 30 of the handle 22 to allow the handle to rotate relative to the locking plate 60 when the latch 38 is in the unlocked position. However, when the handle 22 is rotated to either of the on or off positions, the latch 38 is actuatable (i.e., pushing in the latch and inserting a locking member into the openings 36) to lock the operator 20 in the selected position. For example, when the handle 22 is rotated to the off position, and the latch 38 is pushed in and the locking member is inserted into the openings 36 to place the operator 20 in the locked position, an end of the latch is positioned to engage the flange 64 to prevent the handle 22 from be rotated away from the off position. Similarly, handle 22 can be rotated to the on position, and the engagement of the latch 38 with the flange 64 can prevent the operator 20 from being rotated away from the on position. Stops 68 are also attached to the locking plate 60 and limit the amount of rotation the handle 22 can undergo relative to the locking plate. By limiting the amount of rotation of the handle 22, the operator 20 limits the amount of stress that can be placed on the toggle T in the enclosure 23. This helps to prevent the operator 20 from damaging the circuit breaker CB as a result of placing too much torque on the toggle T. In the illustrated embodiment, flanges 70 are bent from the plate section 62, and the stops 68 are received in holes in the flanges 70. The stops 68 comprise set screws that are secured in the flange holes by nuts 72. Thus, the set screws are adjustable to accommodate manufacturing and component variation. This also allows a user to adjust the position of the set screws 68 to select the degree to which the handle 22 can be rotated. It is envisioned, however, that the stops 68 could be mounted in other ways and have other configurations to limit the rotation of the handle 22. It will be understood that during operation, the handle 22, linkage arm 50, and toggle engagement assembly 26 rotate relative to the enclosure 23 while the locking plate 60 and bearing 54 remain fixed.

Referring to FIGS. 3A-11, the toggle engagement assembly 26 comprises a fork 76 (broadly, an extension arm) and an attachment plate 78 (broadly, an attachment member) releasably attached to the fork. The attachment plate 78 is configured to engage the toggle T on the circuit breaker CB within the enclosure 23 for moving the toggle between the on and off positons. The fork 76 comprises an attachment sleeve 80 for receiving the rectangular portion 58 of the linkage arm 50 to locate the fork on the linkage assembly 24. A set screw 82 extends through a hole in the attachment sleeve 80 for engaging one of the planar side surfaces of the rectangular portion 58 of the linkage arm 50 to secure the fork 76 to the linkage assembly 24. The fork 76 can be secured to the linkage assembly 24 in other ways without departing from the scope of the disclosure. Further, it is envisioned that the fork 76 can be formed integrally with the linkage arm 50.

The fork 76 further comprises a fork member 84 formed integrally with the attachment sleeve 80. The fork member 84 extends laterally from the sleeve 80 and includes a root 86 extending directly from the sleeve 80 and a pair of fingers 88 that extend directly from the root. The fingers 88 extend from the root 86 to free ends. The fingers 88 are spaced apart from each other to define a finger gap 90 extending between opposing inner edges 92 of the fingers. In one embodiment, the finger gap 90 has a minimum width W1 of between about 0.5 inches (1.27 cm) and about 1 inch (2.54 cm). In one embodiment, the finger gap 90 has a minimum width W1 of about 0.76 inches (1.93 cm). The finger gap 90 could have other widths without departing from the scope of the disclosure. In the illustrated embodiment, the fork member 84 is formed integrally with the attachment sleeve 80. However, the fork member 84 can be formed separately from the sleeve 80 and suitably attached to the sleeve. Additionally, the attachment plate 78 can be non-releasably attached to the fork 76. For instance, the attachment plate 78 can be formed integrally with the fork 76, or formed separately and permanently attached to the fork (e.g., by welding). Also, while the extension arm 76 is shown as fork, the extension arm can have any shape or configuration without departing from the scope of the disclosure. For instance, the extension arm may be any structure that attaches the attachment plate 78 to the linkage assembly 24.

Posts 94 extend from respective fingers 88 and engage the attachment plate 78 to space the attachment plate from the fingers. In the illustrated embodiment, the posts 94 extend from breaker facing surfaces of the fingers 88 such that when the operator 20 is mounted to the enclosure cover 25, the posts position the attachment plate 78 closer to the breaker than the fingers. The posts 94 are semi-cylindrical so that an interior space in the posts is visible from a side of the post. Screws 96 extend through the posts 94 to attach the attachment plate 78 to the fork 76. Thus, portions of the screws 96 in the interior space of the posts 94 are visible from the sides of the posts. In the illustrated embodiment, the posts 94 are formed integrally with the fingers 88. However, the posts 94 can be formed separately from the fingers 88 and suitably attached to the fingers. Additionally or alternatively, the posts 94 can be formed as part of the attachment plate 78. The posts 94 can have other configurations without departing from the scope of the disclosure.

Figure 3A:
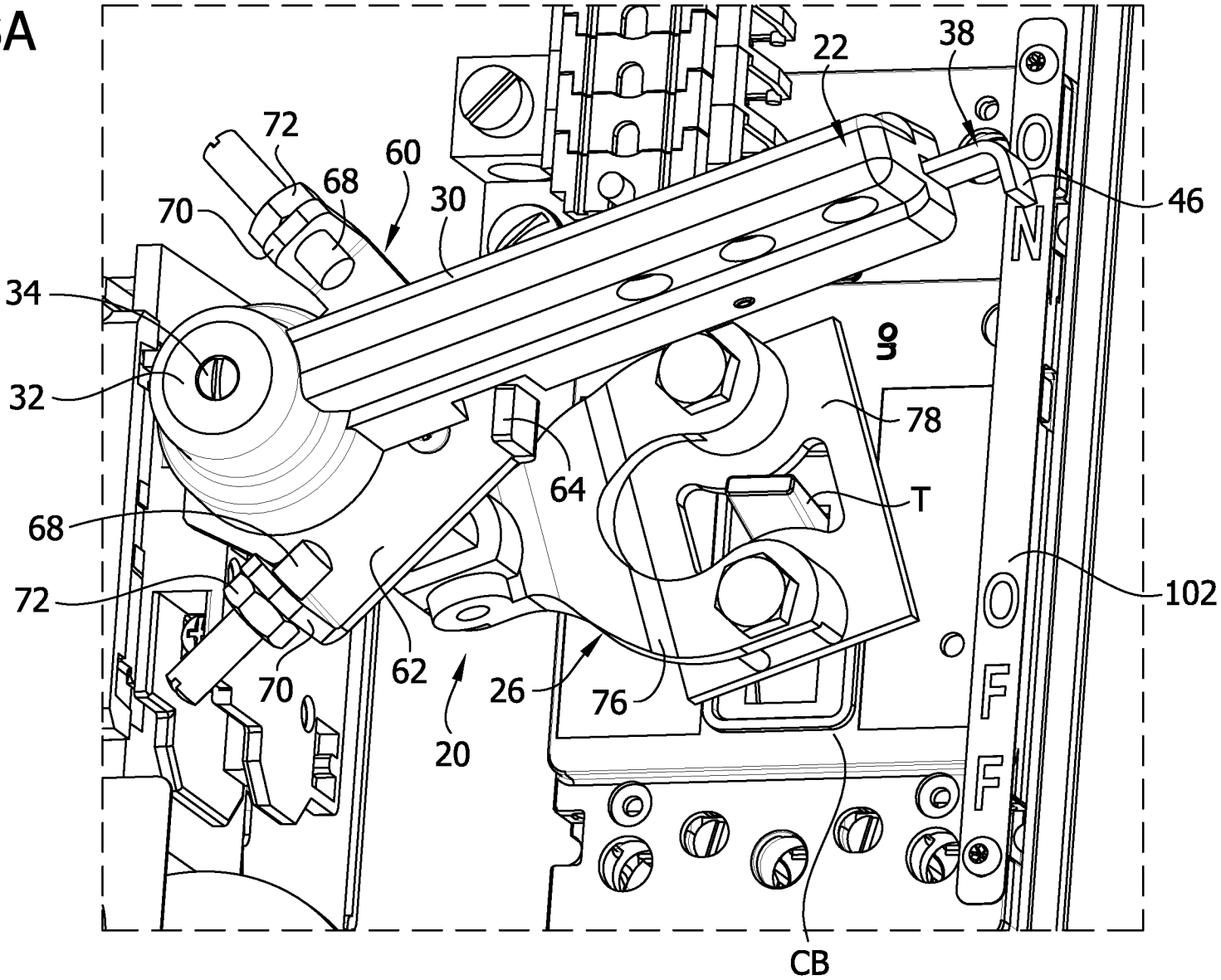
FIG. 3A is an enlarged fragmentary view of the circuit breaker enclosure illustrating the cover as transparent to show internal details in the enclosure.

Referring to FIGS. 4-7, 10, and 11, the attachment plate 78 comprises a rectangular plate member 98 having a cutout 100 formed therein. In the illustrated embodiment, the cutout 100 is formed in a center of the plate member 98 and is located in registration with the finger gap 90 of the fork 76. However, the cutout 100 can be located in other positions on the attachment plate 78. For example, the cutout 100 could be positioned off-center on the plate and/or out of registration with the finger gap 90. Thus, an entirety of the cutout 100 can be laterally spaced from the fork. The position and orientation of the cutout 100 may be selected based on the required toggle engagement operation. The position of the cutout 100 shown in the figures is for illustrative purposes and only represents one option for cutout placement. Additionally, in the illustrated embodiment, the cutout 100 is shown as having an hourglass shape. The hourglass shape of the cutout 100 has a minimum width W2 of between about 0.3 inches (0.76 cm) and about 0.5 inches (1.27 cm). In one embodiment, W2 is about 0.34 inches (0.86 cm). The attachment plate cutout 100 is sized to receive the toggle of the circuit breaker within the enclosure 23 (FIG. 3A). In particular, the attachment plate 78 is designed to more closely receive the toggle than the fork 76 without the attachment plate because the minimum width W2 of the cutout 100 is smaller than the minimum width W1 of the finger gap 90 of the fork. Therefore, a clearance between the toggle T and inner edges of the attachment plate 78 which define the cutout 100 is reduced as compared to the clearance between the inner edges 92 of the fingers 88 of the fork 76 and the toggle providing a closer tolerance between the toggle and the attachment plate. As a result, the movement of the handle 22 is better transferred into movement of the toggle T causing a more reliable actuation of the toggle by the through cover operator 20. In the illustrated embodiment, the cutout 100 is hourglass shaped. However, the cutout 100 may have any shape or size without departing from the scope of the disclosure. Additionally, while the attachment plate 78 is shown as being a rectangular plate, the plate can have other shapes without departing from the scope of the disclosure.

In use, the operator 20 is mounted on the cover 25 of the enclosure 23 such that the handle 22 and locking plate 60 are located outside of an interior of the enclosure. The linkage assembly 24 including the linkage arm 50 and bearing 54 extend through the cover 25 and into the interior of the enclosure 23 such that the toggle engagement assembly 26 is disposed within the interior of the enclosure. When the cover 25 of the enclosure 23 is closed, the attachment plate 78 is disposed adjacent the circuit breaker CB. When properly positioned, the cutout 100 in the attachment plate 78 receives the toggle T of the circuit breaker CB. Rotation of the handle 22 causes the linkage arm 50 and toggle engagement assembly 26 attached to the linkage arm to rotate relative to enclosure 23. Therefore, if the toggle is in the OFF position, the interior edges of the attachment plate 78 which define the cutout 100 will engage the toggle T to flip the toggle to the ON position. Indicia 102 on the front of the cover 25 corresponds to the positions of the toggle T inside the enclosure 23 so that when the handle 22 is rotated to the ON indicia, the attachment plate 78 will engage the toggle to move the toggle to the ON position. Conversely, if the toggle T is in the ON position, rotation of the handle 22 from the ON indicia to the OFF indicia will cause the interior edges of the attachment plate 78 that define the cutout 100 to engage the toggle T to flip the toggle to the OFF position. The close tolerance between the toggle T and the cutout 100 allow the handle 22 to better transfer its movement into movement of the toggle causing a more reliable actuation of the toggle by the through cover operator 20.

Additionally, because the attachment plate 78 is releasably attached to the fork 76, a user can remove the attachment plate from the fork to replace the attachment plate with an alternate plate depending on the circuit breaker and toggle with which the through cover operator 20 is intended to be used. Therefore, the entire toggle engagement assembly 26 does not have to be configured for use with any particular toggle design. Rather, specific attachment plates that are sized, shaped, and configured for use with specific circuit breaker/toggle designs can be selectively attached to the fork 76 as needed. This eliminates the need to tool the entire operator 20 or engagement assembly 26 for each circuit breaker/toggle type.

Figure 12:
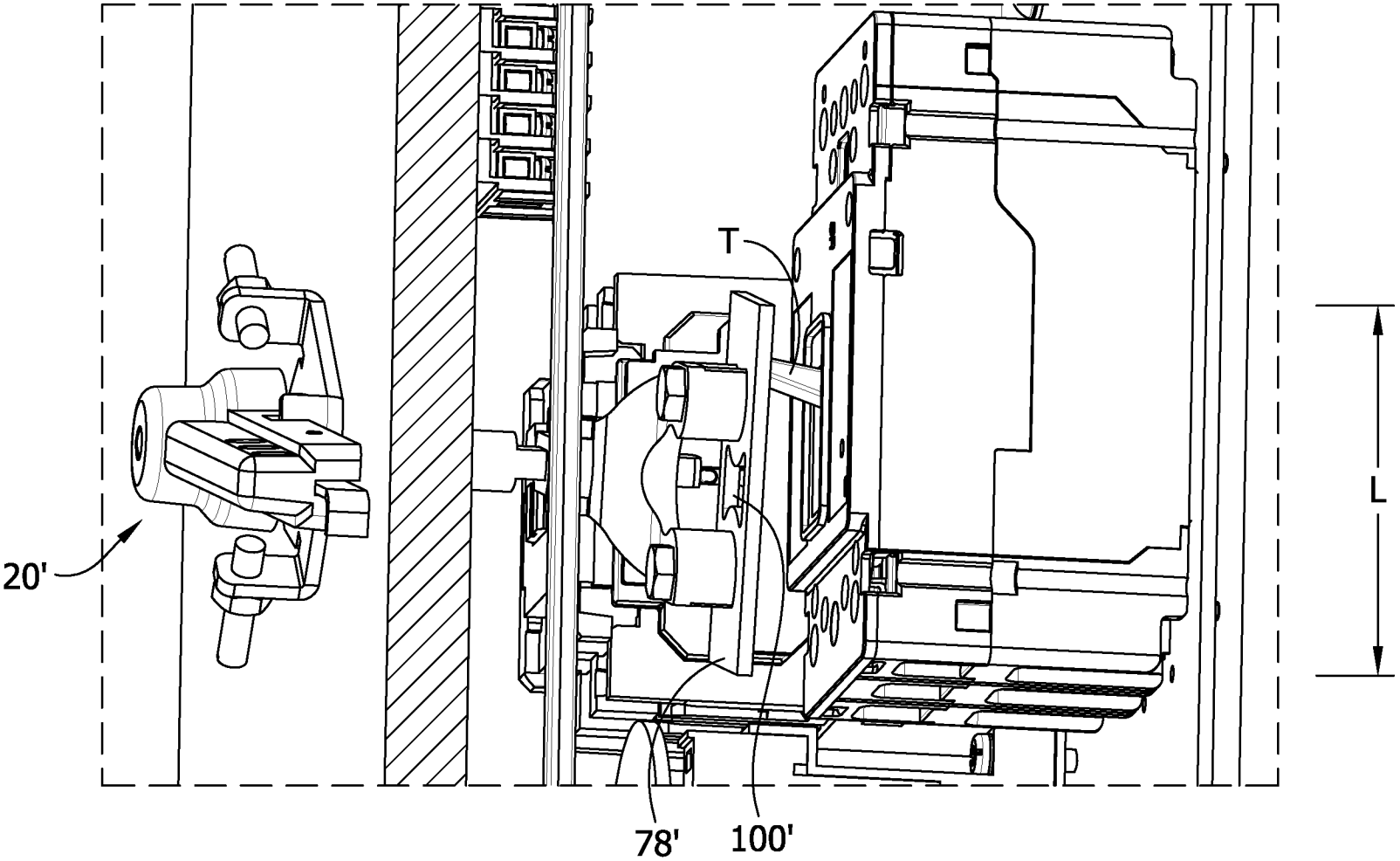
FIG. 12 is a fragmentary view of the circuit breaker enclosure illustrating a portion of the enclosure as transparent to show internal details of a through cover operator of another embodiment mounted to the enclosure.

Referring to FIG. 12, a through cover operator of another embodiment is generally indicated at 20'. The operator 20' is similar to the operator 20 of the first embodiment except that operator 20' comprises an extended attachment plate 78'. For ease of comprehension, where analogous parts are used, reference numerals identical to those in the first embodiment are employed plus a prime. The attachment plate 78' is sized and shaped to engage a circuit breaker toggle T and prevent the enclosure cover 25' from being closed if the operator 20' is not configured such that the toggle is received in the cutout 100' of the attachment plate when the cover is closed. This acts as a fail-safe by only allowing the cover to close when the attachment plate 78' properly engages the circuit breaker toggle T. In one embodiment, the extended attachment plate 78' has a length L of at least about 4 inches (10 cm). The operator 20' otherwise operates in the same manner as the operator 20 of the first embodiment.

Figure 13:
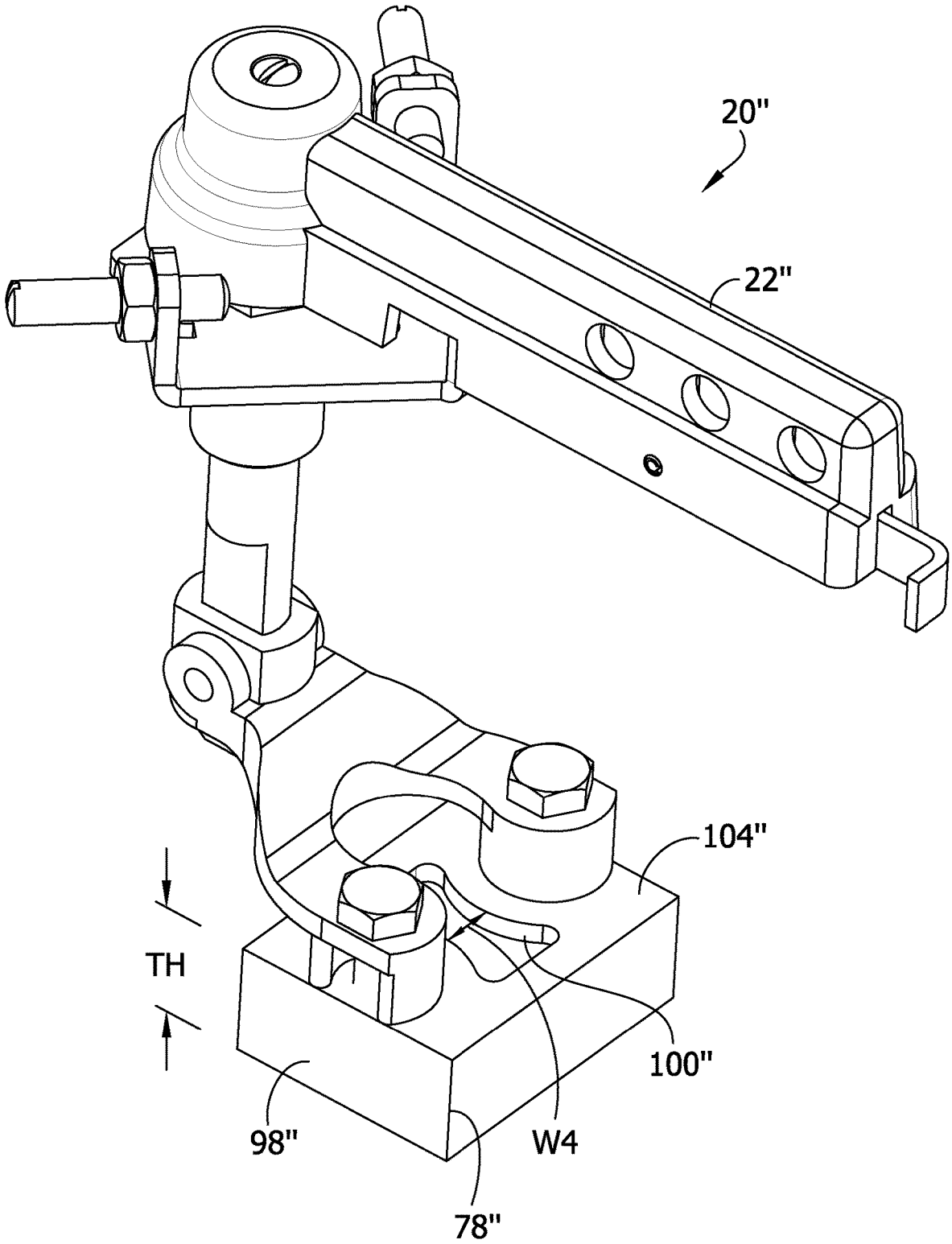
FIG. 13 is a perspective of a through cover operator of another embodiment.
Figure 13A:
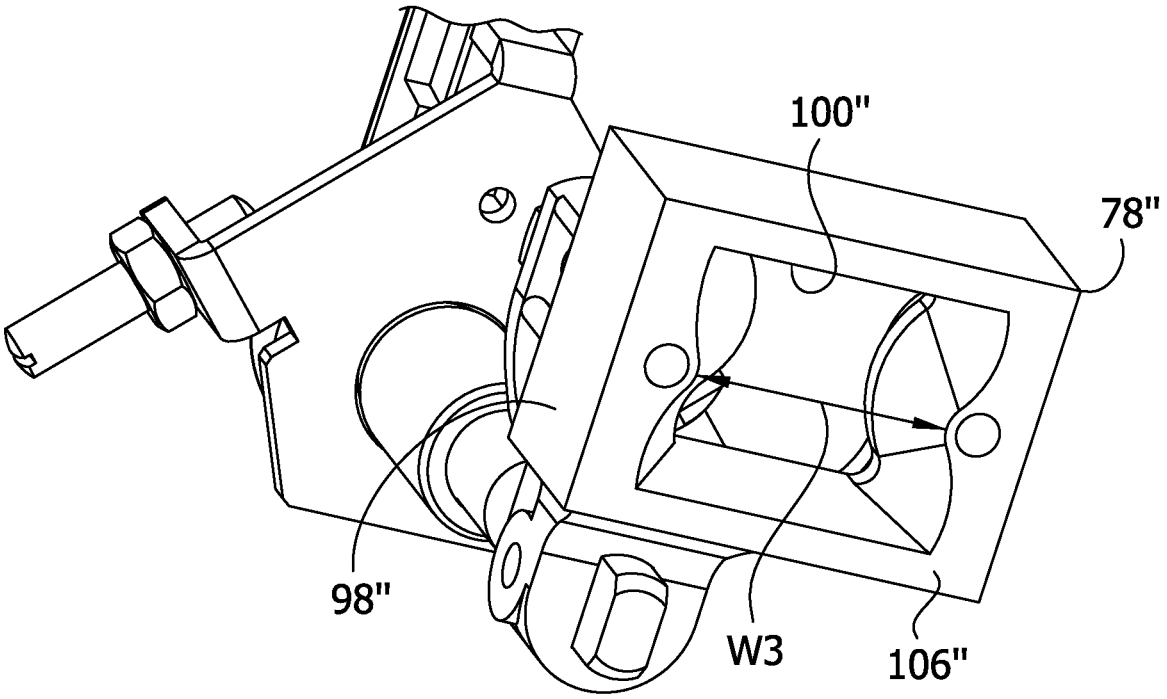
FIG. 13A is an enlarged fragmentary view of the operator in FIG. 13.

Referring to FIGS. 13 and 13A, a through cover operator of another embodiment is generally indicated at 20". The operator 20" is similar to the operator 20 of the first embodiment except that operator 20" comprises a thicker attachment plate 78". For ease of comprehension, where analogous parts are used, reference numerals identical to those in the first embodiment are employed plus a double prime. The attachment plate 78" comprises a rectangular plate member 98" having a cutout 100" formed therein. The plate member 98" has a thickness TH that is greater than a thickness of the plate member 98 of the first embodiment. In one embodiment, the plate member 98" has a thickness TH of about 0.75 inches (1.9 cm). The plate member 98" has a cover facing surface 104" and an opposite breaker facing surface 106". In the illustrated embodiment, the cutout 100" is shown as having an hourglass shape. The cutout 100" tapers from the breaker facing surface 106" to the cover facing surface 104" such that the size of the hourglass shaped opening at the breaker facing surface is larger than the opening at the cover facing surface. Therefore, the hourglass shape of the cutout 100" at the opening in the breaker facing surface 106" has a minimum width W3 of between about 0.75 inches (1.9 cm) and about 1.5 inches (3.81 cm), and minimum width W4 at the opening in the cover facing surface 104" of between about 0.3 inches (0.76 cm) and about 0.7 inches (1.78 cm). In one embodiment, W3 is about 1.13 inches (2.87 cm) and W4 is about 0.5 inches (1.27 cm). The attachment plate 78" is sized and shaped to engage a circuit breaker toggle when the enclosure cover is being closed to move the toggle into the proper position to allow the cover to be fully closed. This acts as a self-aligning feature so that the user does not have to manually place the handle 22" into a position to match the toggle before closing the enclosure cover. Rather, for example, the handle 22" can be rotated to one of the ON and OFF positons with the toggle in the other of the ON and OFF positions. The enclosure cover can be closed and the attachment plate 78" will engage the toggle to flip the toggle to the position of the handle as the enclosure is being closed. The operator 20" otherwise operates in the same manner as the operator 20 of the first embodiment.

Having described the invention in detail, it will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. An operator for an electrical switching apparatus comprising:

an actuator configured to be grasped by a user;

a linkage attached to the actuator at a first end of the linkage and configured for extending through an enclosure housing the electrical switching apparatus; and an engagement assembly attached to the linkage at a second end of the linkage such that when the operator is mounted to the enclosure movement of the actuator outside of the enclosure causes movement of the engagement assembly inside the enclosure, the engagement assembly comprising an extension arm attached to the linkage and extending in a direction transverse to a longitudinal axis of the linkage, and an attachment member attached to the extension arm, the attachment member being configured to engage a toggle of the electrical switching apparatus in the enclosure to move the toggle between at least two positions.

2. The operator of claim 1, wherein the attachment member is releasably attached to the extension arm.

3. The operator of claim 1, wherein the attachment member comprises a body having an opening formed therein, the opening being sized and shaped to receive the toggle such that edges of the body defining the opening are configured to engage the toggle for moving the toggle between the at least two positons.

4. The operator of claim 3, wherein the opening is closed and has an hourglass shape.

5. The operator of claim 3, wherein the opening has a minimum width of between about 0.3 inches (0.76 cm) and about 0.5 inches (1.27 cm).

6. The operator of claim 3, wherein the opening is formed in a center of the member.

7. The operator of claim 3, wherein the extension arm comprises a fork including a pair of spaced apart fingers defining a gap between the fingers.

8. The operator of claim 7, wherein the opening in the member is aligned with the gap between the fingers.

9. The operator of claim 3, wherein the body has fastener holes for attaching the body to the extension arm.

10. The operator of claim 3, wherein the body has a rectangular shape.

11. The operator of claim 10, wherein the body has a length of at least about 4 inches (10 cm).

12. The operator of claim 3, wherein the opening has a taper from a cover facing surface of the body to a breaker facing surface of the body opposite the cover facing surface such that a size of the opening at the breaker facing surface is larger than a size of the opening at the cover facing surface.

13. The operator of claim 1, wherein the engagement assembly is releasably attached to the linkage.

14. The operator of claim 1 in combination with the enclosure, wherein the operator is attached to the enclosure.

* * * * *